US006698406B1

(12) United States Patent
Fabritius et al.

(10) Patent No.: US 6,698,406 B1
(45) Date of Patent: Mar. 2, 2004

(54) PRESSURE SENSOR FOR AN INTERNAL COMBUSTION ENGINE

(75) Inventors: Gerhard Fabritius, Ingolstadt (DE); Gerhard Kaufmann, Ingolstadt (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 09/786,669

(22) PCT Filed: Jul. 24, 1999

(86) PCT No.: PCT/EP99/05306

§ 371 (c)(1),
(2), (4) Date: Apr. 19, 2001

(87) PCT Pub. No.: WO00/15960

PCT Pub. Date: Mar. 23, 2000

(51) Int. Cl.[7] ..... F02M 25/07
(52) U.S. Cl. ..... 123/568.16
(58) Field of Search ..... 123/463, 568.11, 123/568.16

(56) References Cited

U.S. PATENT DOCUMENTS 5,133,323 A * 7/1992 Treusch ..... 123/463
5,205,244 A * 4/1993 Nakamura et al. ..... 123/432
5,263,460 A * 11/1993 Baxter et al. ..... 123/520
5,337,725 A 8/1994 Narita

FOREIGN PATENT DOCUMENTS

| | | |
|---|---|---|
| DE | 3322547 | 1/1985 |
| DE | 3738321 | 5/1988 |
| DE | 3226849 | 6/1992 |
| DE | 19723210 | 1/1998 |
| EP | 0621405 | 10/1994 |
| JP | 59188064 | 10/1984 |

OTHER PUBLICATIONS

Radermacher, B., "Optimierte Kraftstoff–Versorgungssysteme Senken Den Verbrauch" Jan. 1, 1997, pp. 74–76, 78.
Patent Abstracts of Japan, Mar. 6, 1985 & Oct. 25, 1984.

* cited by examiner

*Primary Examiner*—Henry C. Yuen
*Assistant Examiner*—Arnold Castro
(74) *Attorney, Agent, or Firm*—Stevens, Davis, Miller & Mosher, LLP

(57) ABSTRACT

A pressure sensor (40) is mounted in an internal combustion engine (1) for determining induction pipe pressure (P) in a connecting line (30) between the induction pipe (5) and the fuel pressure regulator (35). When checking the exhaust gas recirculation valve (20), induction pipe pressure (P) rises. Said change in pressure is safely and reliably recorded independently of actuation of other pneumatic consumers (vacuum power booster).

2 Claims, 1 Drawing Sheet

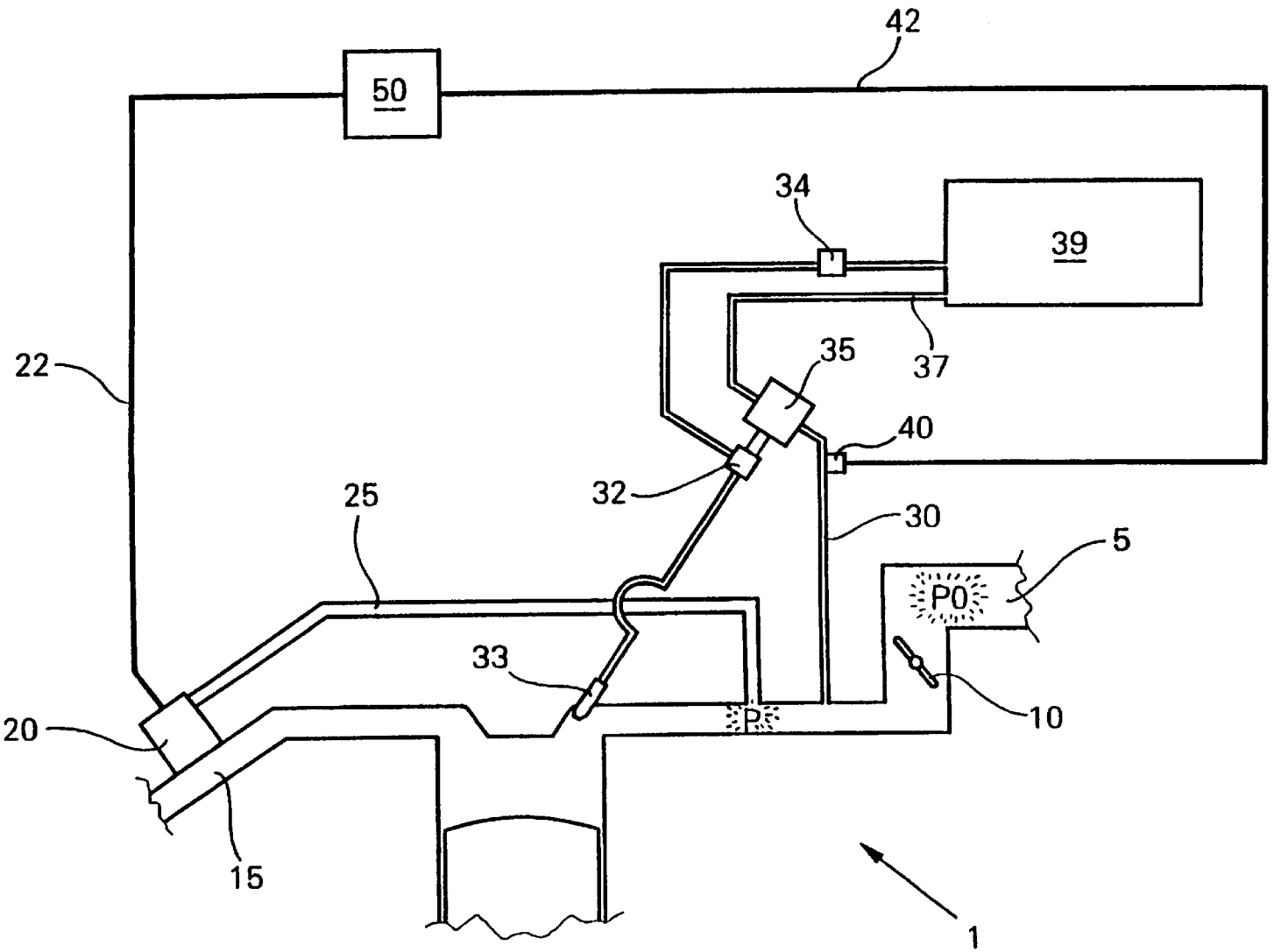
42
39
37
34
35
40
30
5
PO
10
1
32
P
33
50
25
15
22
20

PRESSURE SENSOR FOR AN INTERNAL COMBUSTION ENGINE

The invention relates to a mechanism for monitoring the operating efficiency of an exhaust recalculation valve for an internal combustion engine, with a pressure sensor that determines the pressure in a suction valve of the internal combustion engine.

The pollutant emission of internal combustion engines can be improved by a process termed exhaust recalculation. For this purpose there is provided on the exhaust side of the internal combustion engine an exhaust recalculation valve which controls an exhaust recalculation line ending on the intake side of the internal combustion engine in the intake pipe downstream from the throttle valve. Exhaust is added to the air intake and as a result chiefly the No. Exhaust of the internal combustion engine is reduced.

Since the exhaust recalculation valve represents an exhaust relevant component, its operating efficiency in motor vehicles must be monitored partly on the basis of already existing legal regulations (ODD II). Malfunctions which occur must be stored in a malfunction storage unit for the purpose of display in customer service inspections. The pressure in the intake pipe downstream from the throttle valve increases as a result of opening of the exhaust recalculation valve, that is, addition of exhaust to the air intake.

A simple method of monitoring the exhaust recalculation valve consists of mounting a suitable pressure sensor directly in the suction pipe or at the end of a negative pressure line (U.S. Pat. No. 5,337,725) branching off from the suction pipe, in order to register change in pressure when the exhaust recalculation valve is actuated. Mounting of a pressure sensor such as this on the intake pipe however is very costly from the viewpoint of installation and/or is not always possible because of considerations of space.

Another possibility for monitoring the exhaust recalculation valve is that of mounting the pressure sensor in a connecting line branching from the intake pipe, a line which leads to a compressed-air actuating element such as a vacuum-operated servo brake or vacuum dashpot switching intake pipe. However, this arrangement entails the disadvantage that uncontrollable pressure changes occur in the connecting line involved when such an operating element is actuated. If however an accidental simultaneous actuation of an operating element such as this occurs during testing of operation of the exhaust recalculation valve, the pressure sensor mounted in this connecting line erroneously registers changes in pressure which are not to be attributed to operation of the exhaust recalculation valve. On occasion this can result in generation of an erroneous operational verification result.

It is claimed for the invention that a mechanism with pressure sensor is provided for an internal combustion engine, a sensor in which the disadvantages indicated are avoided, assembly of which is simple and cost-effective, and which simultaneously permits reliable operational testing.

This result is obtained by means of the mechanism with the features described in the patent claim. The essential concept of the invention is represented by mounting the pressure sensor in a line leading to a fuel pressure regulator. A fuel pressure regulator such as this is not in the form of a pneumatic consuming device, that is, no sudden accidental pressure changes which would result in falsification of the measured value in operational testing can occur in the connecting line leading to this fuel pressure regulator. Hence reliable operational testing of the exhaust recalculation valve is made possible by this mounting of the pressure sensor.

The invention is described in detail in what follows on the basis of an exemplary embodiment illustrated in the drawing.

The sole FIGURE presented is a diagram of an internal combustion engine with exhaust recalculation.

On the intake side the internal combustion engine 1 has an intake pipe 5 in which a throttle valve 10 is installed. On the exhaust side the internal combustion engine 1 has an exhaust pipe 15 leading, by means not shown, to an exhaust system of the internal combustion engine 1. There is mounted on the exhaust pipe 15 an exhaust recalculation valve 20 which controls an exhaust recalculation line 25 ending in the suction pipe 5 downstream from the throttle valve 10. A connecting line 30 leads from the suction pipe 5 to a fuel pressure regulator 35, also downstream from the throttle valve 10. The fuel pressure regulator 35 is connected to a fuel tank 39 by way of a fuel return 37. It regulates the fuel pressure in a distributor strip 32 which is also connected to the fuel tank by way of a fuel pump 34. The distributor strip 32 also serves to supply fuel to an injection valve 33.

It is claimed for the invention that a pressure sensor 40 is mounted in the connecting line 30 between suction pipe 5 and fuel pressure regulator 35. A signal line 42 leads from the pressure sensor 40 to a control unit 50.

The control unit 50 controls the exhaust recalculation valve 20 by way of a control line 22.

The operation of the invention is described in detail in what follows. Pressure PO prevails in the suction pipe 5 upstream from the throttle valve 10, while negative pressure P varying with the position of the throttle valve 10 prevails downstream from the throttle valve 10. When the exhaust recalculation valve 20 is actuated by means of the control unit 50, the valve 20 is opened and exhaust reaches the suction pipe 5 by way of the exhaust recalculation valve 25.

As a result the pressure P in the suction pipe 5 increases by $\delta P$. This pressure change has an effect immediately in the connecting line 30. This pressure change $\delta P$ is registered by the pressure sensor 40. Since the connecting line 30 and the fuel pressure regulator 35 in particular have only a very small volume, no significant air flow occurs to equalize the pressure. Hence the change in pressure exerts its effect immediately on the pressure sensor 40 and so is registered without delay.

The pressure sensor 40 generates an undistorted measuring signal of the pressure P in the suction pipe.

Uncontrolled effects resulting from accidental actuation of a pneumatic actuating element affect the measuring signal only to an insignificant extent. Accidental pressure changes in the suction pipe 5 due to changes in the throttle valve angle are detected by the control unit 50, which is part of the engine control unit, and so allowance may be made for them in evaluation of the measurement signal. In order to keep evaluation of the measurement signal as simple as possible, provision is made such that operational testing of the exhaust recalculation valve 20 may be carried out only if there is no change in the angle of the throttle valve 10.

If the torque required is made by the driver through change in the throttle valve angle during a test of operation of the exhaust recalculation valve 20, the operational testing is interrupted and is repeated at a later time.

The essential features of the invention are that the pressure sensor 40 is mounted in a connecting line 30 leading from the suction pipe 5 to the fuel regulator 35. Such a layout is simple from the viewpoint of assembly and at the same time permits reliable operational checking of the exhaust recalculation valve 20.

What is claimed is:

1. A process for monitoring the operating efficiency of an exhaust recalculation valve of an internal combustion engine, with a pressure sensor for determination of a suction pipe pressure in a suction pipe of the internal combustion engine, comprising the following steps:

mounting the pressure sensor in a connecting line leading from the suction pipe to a fuel pressure regulator of the internal combustion engine;

providing a signal from the pressure sensor to a control representing the pressure in the suction pipe; and monitoring the exhaust recalculation valve based upon the signal from the pressure sensor.

2. The process as outlined in claim 1, wherein the monitoring step is ceased during throttling of the internal combustion engine.

* * * * *